United States Patent [19]

Kohler

[11] 4,235,371

[45] Nov. 25, 1980

[54] TRACK ARRANGEMENT FOR A RAILROAD

[75] Inventor: Karl-Albert Kohler, Grünwald, Fed. Rep. of Germany

[73] Assignee: Getzner Chemie Gesellschaft mbH & Co., Bludenz-Bürs, Austria

[21] Appl. No.: 964,688

[22] Filed: Nov. 29, 1978

[51] Int. Cl.[3] ..... E01B 19/00

[52] U.S. Cl. ..... 238/382; 404/31

[58] Field of Search ..... 238/1–3, 238/8, 382; 404/17, 18, 27, 28, 31, 71, 72

[56] References Cited

U.S. PATENT DOCUMENTS

| | | | |
|---|---|---|---|
| B 418,490 | 1/1975 | Condo et al. | 404/27 |
| 3,880,538 | 4/1975 | Burt et al. | 404/28 |

FOREIGN PATENT DOCUMENTS

| | | | |
|---|---|---|---|
| 1658308 | 9/1970 | Fed. Rep. of Germany | 238/2 |
| 2701597 | 7/1978 | Fed. Rep. of Germany | 238/2 |

*Primary Examiner*—John J. Love
*Assistant Examiner*—Ross Weaver
*Attorney, Agent, or Firm*—Toren, McGeady and Stanger

[57] ABSTRACT

A track arrangement including a ballast of broken stones on a supporting subgrade or man-made structure and at least one rail on the ballast is protected against propagation of noise by a damping body interposed between the ballast and the support for the same, the body including at least two superposed layers of material resiliently deformable in three dimensions under applied compressive stress.

8 Claims, 6 Drawing Figures

FIG.1
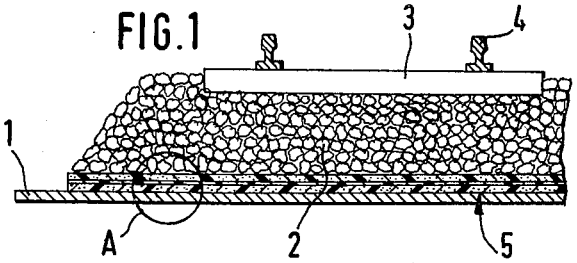
FIG.3
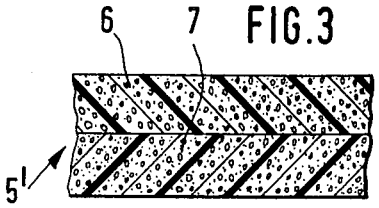
FIG.2
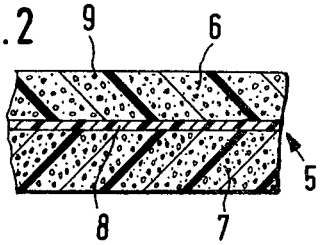
FIG.4
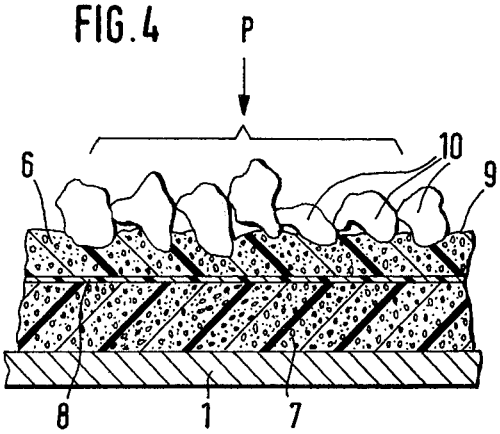
FIG.5
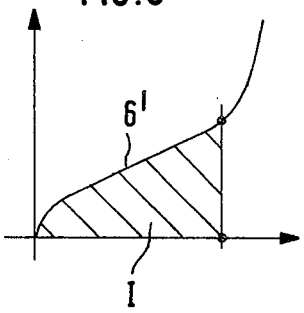
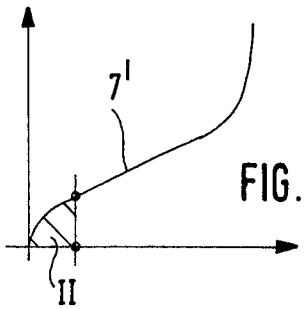
FIG.6

TRACK ARRANGEMENT FOR A RAILROAD

This invention relates to roadbeds for railroads, and particularly to an improved track arrangement in which the propagation of train-generated noise along the track is damped.

It has been proposed to interpose a blanket of rubber sheeting or of bonded rubber granules between the track ballast of broken stones and of steel or concrete surface of a bridge and like man-made structure to reduce the noise produced by passing trains. The rubber would deteriorate quickly in direct contact with the ballast stones, and it is necessary to cover it with a reinforcing layer of more rigid material to extend its useful life. The combined height of rubber blanket, reinforcing material, and ballast would reduce the overhead clearance for the rolling stock on some bridges and the like, so as to prevent use of the damping material which is otherwise desirable although its useful life is limited even under relatively favorable conditions.

It is a primary object of this invention to provide an improved track arrangement achieving the damping characteristics of the known elastically cushioned tracks over longer periods of operation and requiring less vertical clearance.

It has been found that this combination of qualities is possessed by a track arrangement in which a noise damping body interposed between the ballast and the supporting subgrade or man-made structure includes at least two superposed layers of materials resiliently deformable in three dimensions under applied compressive stresses.

Other features, further objects, and many of the attendant advantages of this invention will readily be appreciated as the same becomes better understood from the following detailed description of preferred embodiments when considered in connection with the appended drawing in which:

FIG. 1 shows a track arrangement of the invention in fragmentary front-elevational section;

FIGS. 2 and 3 illustrate damping bodies for use in the track arrangement of FIG. 1 on a larger scale;

FIG. 4 shows elements of the track arrangement in the portion of FIG. 1 indicated by a circle A in a corresponding view on the approximate scale of FIGS. 2 and 3; and FIGS. 5 and 6 are characteristic stress-strain diagrams of resilient materials in the devices of FIGS. 1 to 4 on an arbitrary, but consistent scale.

Referring now to the drawing in more detail, and initially to FIG. 1, there is seen the steel deck 1 of a railroad bridge supporting broken stone ballast 2. Cross ties 3 on the ballast 2 carry two steel rails 4. A noise damping body 5 is interposed between the steel deck 1 and the ballast 2.

As shown on a larger scale prior to installation in FIG. 2, the body 5 consists of two layers 6, 7 of polyurethane foam and a sheet 8 of polyurethane free from the voids characteristics of the cellular materials of the layers 6, 7 between which the sheet 8 is sandwiched. The three layers are laid freely one upon the other and held together by the weight of the ballast 2 which rests on the top surface 9 of the upper cellular layer 6.

In the specific embodiment illustrated, the two layers 6, 7 are of approximately equal thickness of about 12 mm, and the continuous sheet 8 is about 2 mm thick. The modulus of elasticity of the urethane in the sheet 8 is much higher than that of the cellular plastic in the layers 6, 7, and the latter differ somewhat in their respective moduli, the modulus of the lower layer 7 being higher than that of the upper layer 6.

As is shown in FIG. 4, the pressure P due to the weight of the ballast is transmitted to the upper, relatively soft layer 6 by the sharp edges and corners of the lowermost layer of broken stones 10 in the ballast, and the cellular material yields practically to its elastic limit under the concentrated, compressive stresses so that the stones 10 are deeply embedded in the top surface 9. However, the stresses are much more evenly distributed at the interface of the foam layer 6 and the sheet 8, and the negligible elasticity of the latter in the vertical direction of its thickness further equalizes the distribution of stresses transmitted to the lower foam layer 7.

The operating characteristics of the two layers 6, 7 of cellular material are indicated in the stress-strain diagrams of FIGS. 5 and 6. The softer layer 6 normally operates in the region I of FIG. 5 under the characteristic curve 6'. Very little further deformation can be caused in the layer 6 by a pressure increase due to a passing train, as indicated by the steeply rising stress values associated with small strain increases beyond the region I. The lower layer 7 is normally stressed by the overlying ballast and track only within the small area II under the characteristic curve 7', and thus responds to any practical increase in operating stress by a proportional deformation along the linear portion of the curve 7'.

It has been found that the desired noise damping effect may be achieved with cellular layers 6, 7 as thin as 5 mm, and that the thickness of each layer need exceed a maximum of 20 mm only under unusual conditions. Including a sheet 8 having a thickness of 1 to 4 mm, the insulating bodies of the invention do not normally add more than 44 mm, and usually less, to the height of the roadbed.

Best results with the least amount of material have been achieved with a combination of three materials whose moduli of elasticity are related as described above, and this arrangement is particularly preferred because of its very long useful life. However, at least some advantages of the invention are available in the modified body 5' shown in FIG. 3 in which two layers 6, 7 of the same cellular plastic are directly superimposed. Both the damping effect and the service life of the modified body 5' in the otherwise unchanged track arrangement of FIG. 1 are very substantially improved as compared to a unitary body of the same material having a thickness equal to the combined thickness of the two layers 6, 7.

Relatively little is gained by superposing more than two layers of cellular polyurethane and by separating each pair of layers by a urethane sheet so that the greater cost of installing multiple layers is usually not warranted.

Polyurethane is the least expensive material available now that will perform satisfactorily in the track arrangements of the invention. However, other suitably resilient and compressible materials may be substituted for the cellular polyurethane, and an even wider choice of materials is available for the stronger sheeting of the separating layer 8 which need not exhibit significant compressibility in the direction of its thickness, but must yield resiliently under the stresses transmitted from the upper compressible layer 6 to perform its stress distributing function. Its notch toughness should be higher than that of the layer 6, and preferably higher than those of both layers 6, 7 so that the lower layer 7 is protected by the sheet 8 against damage by stones that may penetrate through the entire thickness of the layer 6. The sheet 8 has the added advantage of being normally watertight, and by thereby protecting supporting structure, such as the bridge deck 1, against deterioration by water. The individual layers 6, 7 and sheets 8 are elongated in the direction of the track, and longitudinally juxtaposed sheets 8 may be heat-sealed to each other for better water tightness.

Specific materials and their thicknesses must be chosen for specific applications on the basis of some experimentation and may differ substantially from the properties of the specifically described and illustrated arrangements. The nature of the track supported on ballast over the elastic bodies of the invention is not directly relevant, and a continuous bed of ballast may carry the single rail of a monorail track or multiple tracks.

It should be understood, therefore, that the foregoing disclosure relates only to presently preferred embodiments, and that it is intended to cover all changes and modifications of the examples of the invention herein chosen for the purpose of the disclosure which do not constitute departures from the spirit and scope of the appended claims.

What is claimed is:

1. Insulation layer for damping train-generated noise along the tracks over which a train rides, said insulation layer arranged to be positioned between a support for the track and ballast supporting the track, said insulation layer comprising at least two layers of a resiliently deformable material, wherein the improvement comprises that said at least two layers include a first generally planar layer having an upwardly directed surface and a downwardly directed surface and the thickness dimension thereof extending between the upwardly and downwardly directed surfaces, a second generally planar layer having an upwardly directed surface and a downwardly directed surface and the thickness dimension thereof extending between the upwardly and downwardly directed surfaces and said second layer located below said first layer and arranged to receive downwardly directed compressive force from said first layer, the upwardly directed surface of said first layer being arranged to be in direct contact with the ballast and being three dimensionally deformable under the influence of the ballast, and the downwardly directed surface of said first layer being free relative to the upwardly directed surface of said second layer and transmitting only downwardly directed compressive force to said second layer.

2. Insulation layer, as set forth in claim 1, wherein a separating layer having a modulus of elasticity greater than the first and second layers being located between said first and second layers and having an upwardly directed surface in surface contact with the downwardly directed surface of said first layer and a downwardly directed surface in surface contact with the upwardly directed surface of said second layer so that the downwardly directed compressive force is transmitted from said first layer to said second layer through said separating layer, and said separating layer being formed of a sheet material having a notch toughness higher than that of said first and second layers.

3. Insulation layer, as set forth in claim 1, wherein each of said first layer and second layer comprises a highly elastic cellular plastics material.

4. Insulation layer, as set forth in claim 3, wherein said plastics material forming said first and second layers comprises a soft cellular polyurethane foam.

5. Insulation layer, as set forth in claim 1, wherein said first layer and second layer each have a different modulus of elasticity with the modulus elasticity of said first layer being smaller than that of said second layer.

6. Insulation layer, as set forth in claim 2, wherein said separating layer comprises a sheet of polyurethane free of voids.

7. Insulation layer, as set forth in claim 2, wherein said separating layer being free relative to the downwardly directed surface of said first layer and the upwardly directed surface of said second layer.

8. Insulation layer, as set forth in claim 7, wherein the thickness of said first layer and second layer is approximately equal and the thickness of said separating layer is a fraction of the thickness of each of said first and second layers.

* * * * *